US006791017B2

(12) United States Patent
Oskorep

(10) Patent No.: US 6,791,017 B2
(45) Date of Patent: Sep. 14, 2004

(54) METHODS OF MAKING A GUITAR PICK HOLDER COMPRISING A FLEXIBLE MAGNETIC MATERIAL

(76) Inventor: John Jeffrey Oskorep, 416 W. Briar Pl., Unit #3, Chicago, IL (US) 60657

( * ) Notice: Subject to any disclaimer, the term of this patent is extended or adjusted under 35 U.S.C. 154(b) by 27 days.

(21) Appl. No.: 10/366,263

(22) Filed: Feb. 13, 2003

(65) Prior Publication Data

US 2004/0074368 A1 Apr. 22, 2004

Related U.S. Application Data

(63) Continuation-in-part of application No. 10/348,056, filed on Jan. 21, 2003.
(60) Provisional application No. 60/421,125, filed on Oct. 22, 2002.

(51) Int. Cl.[7] ..... G10D 3/16
(52) U.S. Cl. ..... 84/322; 84/320; 84/321
(58) Field of Search ..... 84/322, 320, 321

(56) References Cited

U.S. PATENT DOCUMENTS

| | | | | |
|---|---|---|---|---|
| 3,181,410 A | * | 5/1965 | Phillips | 84/322 |
| 4,310,978 A | | 1/1982 | Stern | |
| 4,581,266 A | * | 4/1986 | Magnotta | 428/32.8 |
| 5,920,023 A | * | 7/1999 | Ravagni et al. | 84/485 R |

FOREIGN PATENT DOCUMENTS

| | | |
|---|---|---|
| FR | 2577336 | 8/1986 |
| GB | 1468561 | 3/1977 |
| GB | 2292474 | 2/1996 |
| JP | 2000276131 | 10/2000 |

OTHER PUBLICATIONS

Web pages from www.magspec.com printed on Jan. 10, 2003 regarding ProMAG™ magnetic sheets and Paper-STEEL™ products.
Copies of front and rear packaging for Avery© product called "Ink Jet Magnetic Sheets" (3270).
Web pages from http://www.somervellguitars.com/Idin-g–on.html printed on Feb. 13, 2003 regarding Kling–On™ Guitar Top Protectors.

* cited by examiner

*Primary Examiner*—Shih-Yung Hsieh
(74) *Attorney, Agent, or Firm*—John J. Oskorep, Esq.

(57) ABSTRACT

Methods of making guitar pick holders from flexible magnetic materials are described. In one illustrative example, a magnetic side of a flexible magnetic sheet is laminated with a vinyl sheet which provides a coloring and/or design. The side opposite this magnetic side is laminated with a static cling vinyl sheet, after text is reverse-printed on its non-static cling side. Coloring, design, and/or text may also be printed on the vinyl sheet. The laminated flexible magnetic sheet is then die cut to simultaneously form a plurality of guitar pick holders of a predetermined shape. Other methods are described, including methods of individually making custom guitar pick holders.

25 Claims, 4 Drawing Sheets

METHODS OF MAKING A GUITAR PICK HOLDER COMPRISING A FLEXIBLE MAGNETIC MATERIAL

CROSS-REFERENCE TO RELATED APPLICATION

This application is a continuation-in-part of a U.S. patent application entitled "Guitar Pick Holder Made Of A Flexible Magnetic Body" having U.S. Ser. No. 10/348,056 and a filing date of Jan. 21, 2003, which is a conversion of U.S. provisional patent application entitled "Magnetic Guitar Pick Holding System" having U.S. Serial No. 60/421,125 and a filing date of Oct. 22, 2002, which are hereby incorporated by reference herein.

BACKGROUND

1. Field of the Invention

The present invention relates generally to methods of making a guitar pick holder from a flexible magnetic material.

2. Description of the Problem

A guitar is typically played with a "guitar pick", which is used to strike or pluck strings of the guitar. Many guitar players carry a number of guitar picks with them as they are relatively small, easily lost, and inexpensive. However, it is often inconvenient to store or retrieve guitar picks. Guitar picks are typically carried in pants pockets and/or within guitar cases and need to be retrieved when the guitar is played. When a guitar is taken out of its guitar case, for example, a guitar pick must be retrieved from some location. Conversely, when a guitar is placed back in its case, the guitar pick must be stored somewhere. When a guitar player is playing and accidentally drops or intentionally tosses away the guitar pick, it is desirable to be able to quickly retrieve another one.

The appearance of guitars and guitar picks are also important to guitar players, and therefore it is preferable that any method used to hold or carry guitar picks does not detract from how these items look. Furthermore, any guitar pick holding system should be inexpensively made so that it may become commercially available and ubiquitous to a large number of consumers. Promotional techniques are also important in the industry.

In co-pending U.S. patent application entitled "Guitar Pick Holder Made Of A Flexible Magnetic Body" having U.S. Ser. No. 10/348,056 and a filing date of Jan. 21, 2003, a guitar pick holder made of a flexible magnetic body is described and claimed. The flexible magnetic body has a rear adhering surface for adhering to a surface of a guitar and a front magnetic surface for magnetically holding a guitar pick. The guitar pick for use with the guitar pick holder is made of a synthetic material (e.g. plastic) but also includes a magnetically receptive material (e.g. metal such as iron). The flexible magnetic body is preferably thin, flat, and formed into a decorative shape to provide a visually appealing design for the guitar. A layer of coloring and/or design may be formed over the front magnetic surface. This layer could be printed directly on the front magnetic surface, or alternatively on a layer of paper or vinyl which covers the front magnetic surface. The rear adhering surface is preferably a static cling vinyl surface, but in other embodiments it may be an adhesive surface or a magnetic or metal surface which is magnetically receptive. A removable backing sheet may be provided to cover the rear adhering surface, and removed before the use of the flexible magnetic body. Other details are described therein.

What are needed are methods of making these or similar guitar pick holders from magnetic material for economical large-scale production as well as for small-scale custom production. The subject and claims of the present application are directed to such methods.

SUMMARY

Methods of making guitar pick holders from flexible magnetic materials are described and claimed. In one illustrative example, a magnetic side of a flexible magnetic sheet is laminated with a vinyl sheet which provides a coloring and/or design. The side opposite this magnetic side is laminated with a static cling vinyl sheet, after text is reverse-printed on its non-static cling side. Text may also be printed on the vinyl sheet. The laminated flexible magnetic sheet is then die cut to simultaneously form a plurality of guitar pick holders with a predetermined shape. Other methods are described, including methods of making custom individual pick holders.

DETAILED DESCRIPTION OF THE PREFERRED EMBODIMENTS

Figure 1:
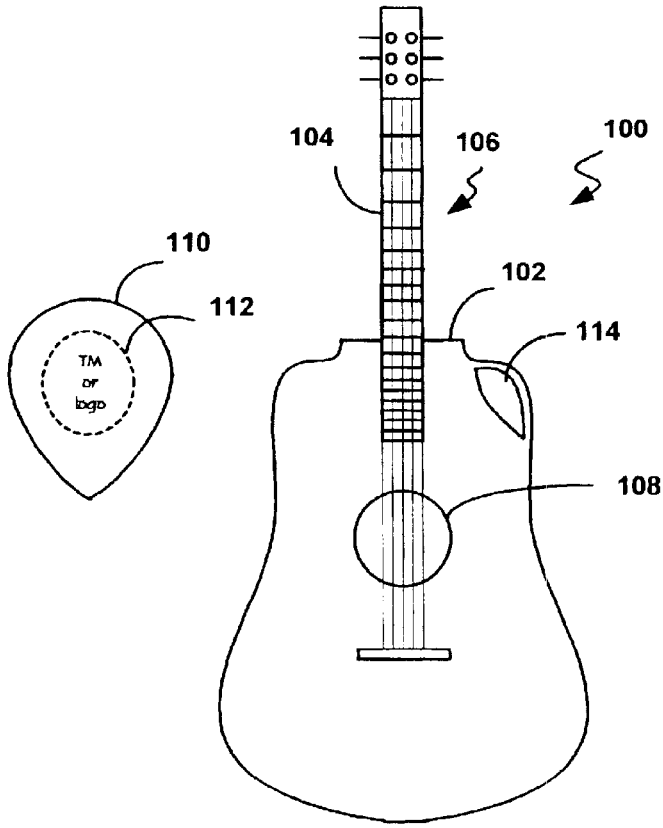
FIG. 1 is an illustration of a guitar with a guitar pick holding system which includes a flexible magnet and a guitar pick having a magnetically receptive material.

FIG. 1 is an illustration of a guitar 100 and a guitar pick 110 for use in connection with a guitar pick holder of the present application. Guitar 100 is a conventional acoustic guitar having a guitar body 102, a neck 104, a sound hole 108, and a plurality of guitar strings 106 (six in total). Guitar 100 may alternatively be an electrical guitar, such as a 6-string electric guitar or a bass guitar. Guitar body 102 is typically made of wood, but could be made of other suitable materials and include a lamination. Typically, guitar body 102 has a transparent or translucent gloss finish. The plurality of guitar strings 106 are typically made of steel, some of which may be wound with nickel.

Guitar pick 110, which is shown in FIG. 1 in enlarged view relative to guitar 100, is generally made of a flexible or resilient synthetic material, such as a plastic (e.g. nylon, delrin, tortex, celluloid, acetal, etc.). In this application, however, a magnetically receptive material 112 is also formed on or within guitar pick 110. Magnetically receptive material 112 is any suitable material that is attracted by magnetic forces, and includes materials such as a metal (e.g. iron, nickel, cobalt, etc.), a metal alloy, a magnetic material, and others.

A guitar pick holder of the present application is made of a flexible magnet 114 which is used to magnetically carry guitar pick 110. Flexible magnet 114 has a rear adhering surface for use in adhering to a surface of guitar body 102, and a front magnetic surface for use in magnetically carrying guitar pick 110.

In general, a flexible magnet is a magnet that is flexible. Rubber or plastic is generally used in combination with magnetic material (e.g. ferrite magnetic powder) for making such a flexible magnet. Integrally formed together, these materials are typically used to make common "refrigerator" magnets. As an example, a flexible rubber magnet is basically a composite material which combines ferrite magnetic powder and compound rubber. Due to its characteristics, a rubber magnet can be easily formed into any complicated shape. Unlike a hard ferrite magnet which is normally fragile against to shock, a rubber magnet is flexible and not easy to break or crack. It may be manufactured with appropriate flexibility and cut into any size with a knife or scissors (or die cut) to meet a specific requirement. Flexible magnetic sheets, with or without adhering backing surfaces, may be obtained from any suitable manufacturer or company such as from Magnetic Specialty Inc. having offices at 707 Gilman Street, Marietta, Ohio, 45750, USA.

Figure 2:
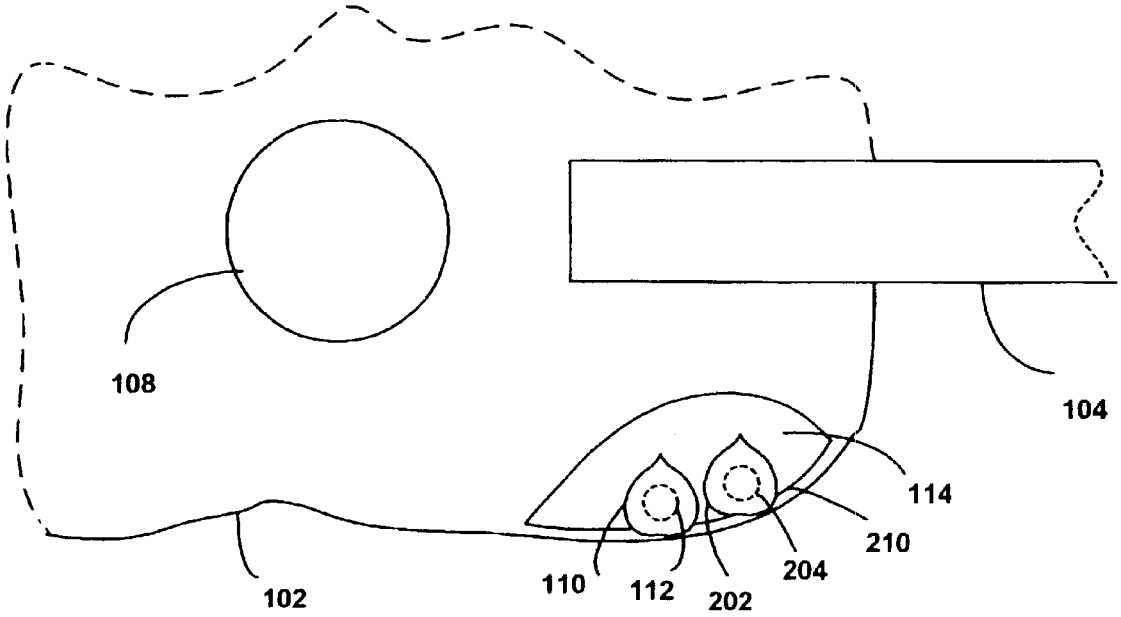
FIG. 2 is a close-up illustration of the guitar pick holding system of FIG. 1 in use with the guitar.

In FIG. 2, a close-up illustration of the guitar pick holding system of FIG. 1 in use with guitar 100 is shown. As shown, guitar pick 110 is held and carried over the outside front surface of guitar body 102 due to its magnetic attraction to flexible magnet 114, which is adhered to the guitar's front surface. This remains true even when the guitar is held in the position shown (i.e. guitar pick 110 being subject to downward gravitational forces) and even when it is subject to relatively strong forces of accelerative motion (i.e. guitar body 102 is physically handled or shaken). Advantageously, the magnetic forces provided by flexible magnet 114 are sufficiently large enough to magnetically carry guitar pick 110 with guitar body 102 but also sufficiently small enough so as not to interfere with any electronics used in connection with the guitar.

Preferably, flexible magnet 114 is positioned along a front bottom edge (right-handed perspective) above sound hole 108 of guitar 100, as shown in FIGS. 1 and 2. However, any suitable areas of attachment may be utilized. FIG. 2 also shows that additional guitar picks 202 having magnetically receptive material 204 may be included in the system. Preferably, flexible magnet 114 is thin (e.g. less than 5 mm or 0.2 inches in thickness) and has a length of between about 7.6–12.7 cm (between about 3–5 inches) to simultaneously accommodate a number of different guitar picks. Preferably, flexible magnet 114 has sufficient flexibility to maintain conformity to curved surfaces of guitar body 102 (e.g. curved side edges) if desired or needed.

Figure 3:
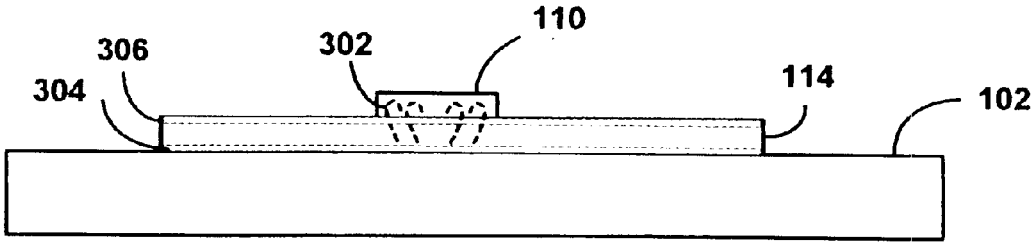
FIG. 3 is a cross-sectional view of the guitar pick holding system of FIGS. 1–2.

FIG. 3 is a cross-sectional view of the guitar pick holding system on guitar body 102 of FIG. 2. Thicknesses and relative thicknesses of the materials are exaggerated in FIG. 3 for illustrative purposes only. As shown, an adhering layer 304 is provided on a first surface of flexible magnet 114 opposite a second surface which provides a magnetic field 302 for attracting guitar pick 110. Adhering layer 304 provides for a semi-permanent attachment of flexible magnet 114 to guitar body 102. The rear adhering surface of flexible magnet 114 is preferably flat so that it conforms and adheres well to a variety of non-planar surfaces (e.g. curved side edges) as well as planar surfaces of a guitar body 102.

Preferably, adhering layer 304 is a static cling vinyl layer. This static cling vinyl layer may be adhesively attached to the rear surface of flexible magnet 114. Static cling vinyl is typically used for decorative purposes, such as for seasonal window graphics, signs, decals, or protective masking applications. Static cling vinyl is a special formulation of polyvinyl chloride (PVC) to which a large amount of plasticizer (a liquid) has been added. This highly plasticized formulation is very pliable. The vinyl is typically calendered to give it a smooth finish. When such film is applied to a smooth glossy surface (e.g. a guitar body), it adheres firmly without the need for an adhesive. Because there is no adhesive, application is very easy and it can be removed and reapplied nearly indefinitely.

Such static cling vinyl materials may be obtained from any suitable manufacturer or company, such as from Beacon Graphics having offices at 189 Meister Avenue, Somerville, N.J., 08876, USA. Although a particular formulation for static cling vinyl has just been described, other formulations may exist or be devised and the term "static cling vinyl" is intended to include such other alternative formulations which achieve the same results. Also, it is contemplated that the flexible magnet materials and static cling vinyl materials could be integrally formed or blended together in the same flexible magnetic body.

Some guitar surfaces have a nitrocellulose lacquer, which may be marred by plasticized PVC. Thus, in an alternate embodiment, adhering layer 304 of flexible magnet 114 is an adhesive layer. The adhesive may be a heavy adhesive or light temporary adhesive, and preferably one which leaves no adhesive residue (e.g. an adhesive which provides for reapplication and repositioning, such as a Post-It™ notes type adhesive by Spencer Silver) and provides an impermanent bond. Most manufacturers typically provide flexible magnetic sheets with an optional adhesive backing. More particularly, a low-tack micro-voided adhesive, called Supercling, is available from Plastiprint, Inc. of 445 Union Boulevard, Suite 209, Lakewood, Colo., 80228 USA. In yet another alternate embodiment, adhering layer 304 includes metal or magnetic material, which provides flexible magnet 114 with a magnetic attraction to a guitar body which has a metal or magnetic material surface.

Figure 4:
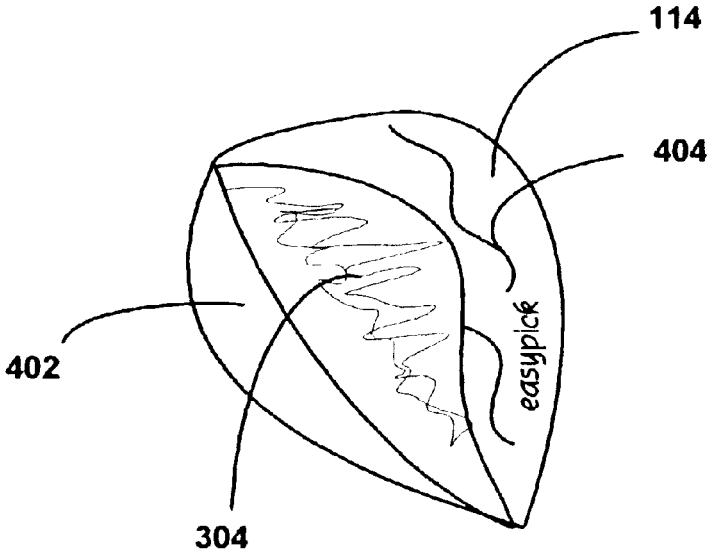
FIG. 4 is a perspective view of the flexible magnet which has a removable backing sheet which covers an adhering surface thereof.

As shown in the illustration of FIG. 4, flexible magnet 114 may also be provided with a removable backing sheet 402 over adhering layer 304 which is removed prior to attachment of flexible magnet 114 to guitar body 102. This removable backing sheet 402 is provided especially where adhering layer 304 includes a static cling vinyl or adhesive surface.

Referring back to FIG. 3, similar to the rear adhering surface, the front magnetic surface of flexible magnet 114 is preferably flat. A flat front magnetic surface provides a good "sliding" action for easy removal of guitar pick 110 (e.g. the thumb may press and slide the pick off the edge of guitar body 102, where it is captured between the thumb and index finger). In the case where the front magnetic surface is formed to be flat, there may be a concern that guitar pick 110 will tend to slide off of guitar body 102 due to forces of gravity or accelerative motion (e.g. sudden guitar movements). However, magnetic field 302 over this surface is made sufficient such that guitar pick 110 normally remains held against flexible magnet 114 even when guitar body 102 is physically handled and shaken. Although magnetic forces 302 provided by flexible magnet 114 are sufficiently large enough to magnetically hold guitar picks in this manner, they are also sufficiently small enough so as to not interfere with any electronics used in connection with the guitar.

As shown in FIG. 3, a layer 306 of printed coloring and/or design (and/or a gloss finish) may be provided over the front magnetic surface of flexible magnet 114. A brand name may also be provided on the viewable surface, as shown in FIG. 4, which may additionally or alternatively include a visual design 404 or graphics image, a company name, a company logo, a band name, a band logo, or a band player's name. To provide such a layer of coloring, design, and/or text, any suitable technique may be used such as screen printing, label printing, offset printing, or colored laminates including vinyl or paper. As a preferred example, a black or white glossy vinyl "sticker" material may be provided on the front magnetic surface of flexible magnet 114. As another preferred example, a holographic "sticker" material may be formed or cut to fit the front magnetic surface. Such holographic materials are available from manufacturers or companies such as Amagic Holographics, Inc. of Irvine, Calif., U.S.A. As even another preferred example, a wood grain (e.g. maple or spruce) print may be provided on a vinyl or paper material formed or cut to fit the front magnetic surface, which is more suitable for acoustic guitars. Preferably, the color or design provided on the surface of flexible magnet 114 is the same or similar color or design provided on each surface of guitar pick 110. If a holographic sticker material is used, for example, the same or a similar holographic surface is provided on each surface of guitar pick 110.

Reference is now made generally to FIGS. 1–4 in combination. It is preferred that flexible magnet 114 be relatively thin. When flexible magnet 114 is kept thin, its front magnetic surface remains relatively flush with the surface of guitar body 102 so that guitar picks may be easily handled. For example, when guitar pick 110 is pressed to be slid off the edge of flexible magnet 114, it may get further slid along the front surface of guitar body 102 (or its edge) until it is captured by the fingers of the guitar player. Also, since flexible magnet 114 is so thin, when guitar pick 110 is pressed on an edge of flexible magnet 114 with the front surface of guitar body 102, it tilts with a relatively small angle so as maintain sufficient magnetic attraction with the front magnetic surface of flexible magnet 114 (i.e. it tends not to "pop" off when so depressed). A thin flexible magnet 114 also has a tendency to stay clear of obstructions which may jar guitar pick 110 and/or flexible magnet 114 off of guitar body 102. A thin flexible magnet is preferably sufficiently flexible such that it easily maintains conformity to curved surfaces (e.g. side edges) of a guitar body, even when the rear adhering layer is relatively weak (e.g. static cling vinyl). Finally, a thin constitution also helps provide flexible magnet 114 with the appearance of a decorative "decal" for decorating the front surface of guitar 100.

A thin flexible magnet is one that has a thickness of about 5 millimeters or less (about 0.2 inches or less). More particularly, it is preferred that flexible magnet 114 has a thickness of 1 millimeter or less (about 0.04 inches or less), or a thickness of 0.5 millimeters or less (about 0.02 inches or less). It is most preferred, however, that flexible magnet 114 has a thickness of about 0.3 millimeters or less (about 0.012 inches or less). Alternatively, a thickness of between about 0.254 millimeters or less (about 0.010 inches or less) may be suitable. It has been observed that, if flexible magnet 114 is made too thin, its edges or corners tend to curl up over time (several days or weeks) when a relatively weak adhering layer (e.g. static cling vinyl) is utilized. Conversely, if flexible magnet 114 is made too thick it becomes less flexible to maintain conformity over time to curved surfaces, as it tends to "pop off" when a relatively weak adhering layer (e.g. a static cling vinyl layer) is utilized. It has been determined that flexible magnet 114 having a thickness that is greater than 0.254 mm (or 0.010 inches), say approximately 0.3 mm (or 0.012 inches), provides a good tradeoff and alleviates these concerns when static cling vinyl is used. A slightly thicker flexible magnet 114, say approximately 0.38 mm (or 0.015 inches), may provide better attraction when covering flexible magnet 114 and guitar pick 110 with vinyl laminates.

Such thin flexible magnetic material may be obtained from, for example, Magnetic Specialty, Inc. mentioned earlier. ProMAG® magnetic sheets may be obtained for this application, with thicknesses ranging from 0.25 mm (0.010 inches) to 1.5 mm (0.060 inches). These sheets may be obtained with or without laminates such as vinyl, paper, or adhesive, colored or uncolored, and used in the present application. ProMAG® is a registered trademark of Magnetic Specialty, Inc.

Although flexible magnet 114 may be formed with any suitable length and width, it is preferred that flexible magnet 114 have a length of between about 6.35 centimeters (about 2.5 inches) to 11.43 centimeters (about 4.5 inches), and a width of between about 1 centimeter (about 0.4 inches) to 2.5 centimeters (about 1 inch). Most preferably, flexible magnet 114 has a length of about 8.9 centimeters (about 3.5 inches) and a width of about 1.5 centimeters (about 0.6 inches), suited to fit to most electric guitars along their narrow bottom "handle" near where a guitar player's fingers generally rest. With the most preferred length and width, flexible magnet 114 has a surface area sufficient to hold at least three guitar picks. Note that the width of flexible magnet 114 need not (and preferably does not) cover the entire surface area of guitar pick 110; the surface area of flexible magnet 114 may cover only between about 50%–80% of each guitar pick 110. For example, flexible magnet 114 may cover about 75%, 66%, or 50% of the surface area each guitar pick 110.

Figure 5:
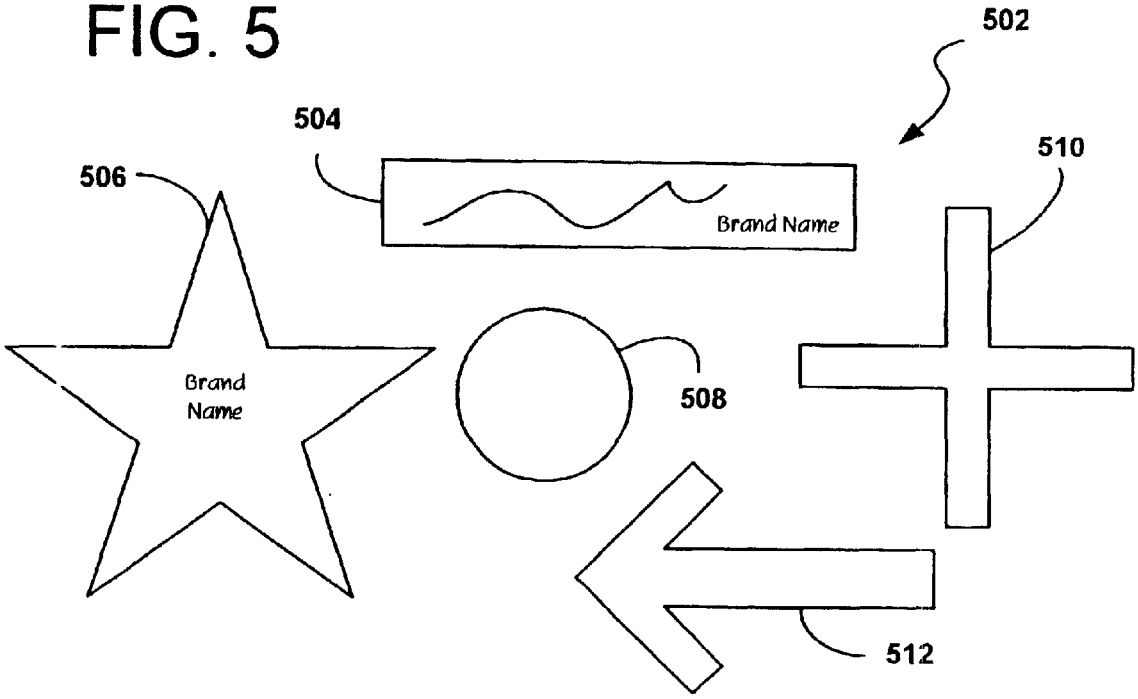
FIG. 5 is an illustration of a plurality of flexible magnets with different predetermined decorative shapes.

It is also desired that flexible magnet 114 take on a variety of visually appealing shapes, styles, and colors. In this case, flexible magnet 114 may be viewed as a decorative design for a front surface of a guitar (which may include a printed decorative coloring or design). FIG. 5 is an illustration of a plurality of flexible magnets 502 with different predetermined shapes, such as a rectangle 504, a star 506, a circle 508, a cross 510, and an arrow 512. Other shapes may be provided, such as a diamond, one or more footprints, a lightning bolt, an S-shape, a Z-shape, an arc, an ellipse, etc. The shape may be in the form of a pickguard of a guitar, and be used for such purpose. Preferably, flexible magnets 502 are either white or black. Other suitable colors may be used as well, such as the color red, yellow, blue, green, etc. Flexible magnets 502 may be sized approximately as shown in FIG. 5. Each of these flexible magnets 502, as described above, has an adhering layer on a rear surface (with a removable backing sheet which covers the adhering layer) and a front surface which provides a magnetic field (and preferably including a coloring/design and/or glossy layer). Thus, if the flexible magnet is very thin and has a decorative shape, it appears to be a cosmetic "decal" or design on the front surface of a guitar. Flexible magnets 502 may be attached anywhere on the guitar (or other objects such as guitar cases, guitar straps, etc.) for decorative design as well as for holding guitar picks.

With reference back to FIG. 2, in one particular embodiment flexible magnet 114 has an edge 210 formed with an arcuate shape which conforms to an arcuate edge along a front surface of a typical acoustic guitar body 102. With such shaping, flexible magnet 114 appears to "blend" into guitar 100 as part of the guitar's intended design. This shape will also advantageously conform to the similarly formed adjacent corner along the front surface of acoustic guitar body 102, which is important since many acoustic guitars have a "cutaway" along the corner shown in use in FIG. 2. In an even more particular embodiment, flexible magnet 114 has an edge 210 which is formed with an arcuate shape that is symmetrical, so that it conforms and fits in the same manner on either arcuate corner of the front surface of acoustic guitar 100.

Figure 6:
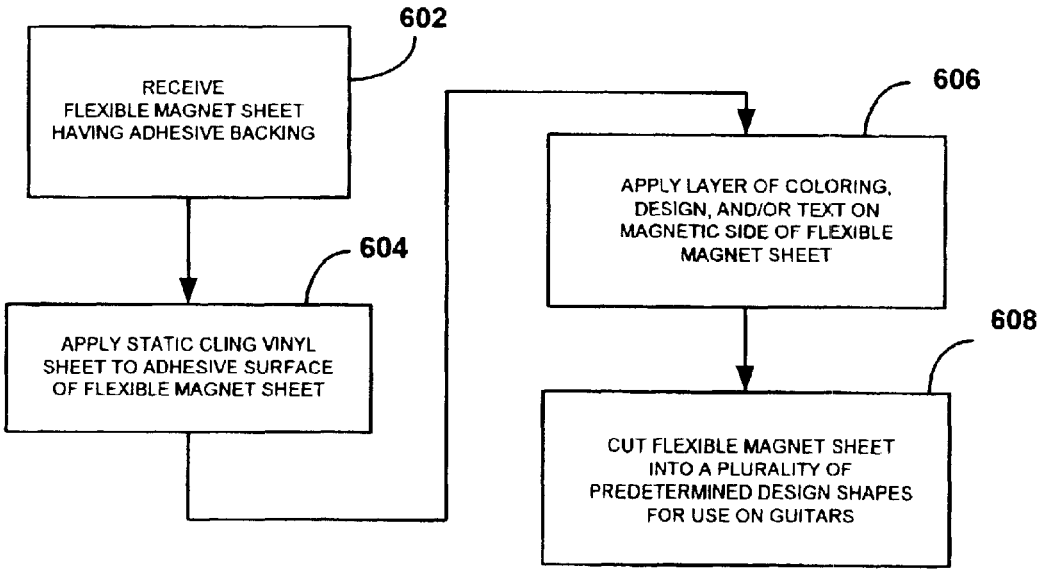
FIG. 6 is a flowchart which describes one method of making a guitar pick holder described herein.

FIG. 6 is a flowchart which describes one method of making a guitar pick holder with a flexible magnetic body. This method may be performed on a mass scale to provide a large number of flexible guitar magnets, or on a small scale so that individuals can custom make their own designs (e.g. band names and/or logos).

A flexible magnetic sheet having a magnetic surface and an adhesive surface opposite the magnetic surface is received (step 602 of FIG. 6). This flexible magnetic sheet has a surface area that is larger than the surface area of the resulting flexible guitar magnet(s). For example, the flexible magnetic sheet may have a length and width of about or at least 8.5"×11" (i.e. at least about 21.6 cm×27.9 cm). Such flexible magnetic sheets are widely available and are commonly used to create custom "refrigerator" type magnets. The flexible magnetic sheet may have a thickness which is the same as the flexible magnets described above in relation to FIGS. 1–5.

The flexible magnetic sheet has a removable backing sheet which temporarily covers the adhesive surface. This removable backing sheet is removed and a static cling vinyl sheet is applied to the adhesive surface (step 604 of FIG. 6). The static cling vinyl sheet has a surface area that is substantially the same as, or is comparable to, the surface area of the flexible magnetic sheet. Thus, a single sheet of flexible magnetic material and static cling vinyl is made. It is noted that steps 602 and 604 may be combined, simply such that a flexible magnetic sheet having a rear static cling vinyl surface is received. This sheet may be referred to as a flexible magnetic sheet with a static cling vinyl laminate.

Static cling vinyl sheets are typically made available with a removable backing sheet and, preferably, this removable backing sheet is kept in place during the process for protection of the static cling vinyl. In addition, it may be desirable to have a design or text printed on the rear side of the flexible magnet. If this is desirable, prior to laminating the flexible magnetic material with the static cling vinyl, a non-static cling side of the static cling vinyl sheet may be printed on. If text is to be provided, a reverse or mirror-image printing of the text is performed on the non-static cling side of the static cling vinyl. This way, once it is laminated, text will be readable on the rear side of each flexible magnet (i.e. on the static-cling side of the static cling vinyl). As some text examples, the text may provide a copyright notice, a trademark notice, a patents pending notice, one or more patent numbers, a disclaimer, a website address, a telephone number, a company name, etc. After such printing and static cling vinyl lamination, only the rear side of the static cling vinyl's removable backing sheet will be visible.

A layer of coloring, design, and/or text, is then provided on the magnetic surface of the flexible magnetic sheet (step 606 of FIG. 6). Any suitable designs and/or colors may be used. Black and white colors are preferred, and custom printed band names may be provided. As alternatives, for example, a holographic image or a wood grain image may be provided. Step 606 may be performed in a few different ways. The coloring, design, and/or text may be provided or printed directly on the magnetic surface of the flexible magnetic sheet. Alternatively, a layer of paper or vinyl may be provided with or printed on with the appropriate coloring, design, and/or text, and thereafter adhesively attached to the magnetic surface of the flexible magnetic sheet. For large scale production, a number of the same or different text, colorings, and/or designs are provided on the same laminated sheet, so that a plurality of flexible guitar magnets can be made from the same sheet.

For a custom-made individual application, a sticker sheet (for example) which is ink-jet compatible and sized to be received in a conventional computer printer (e.g. 8.5"×11" or other) (i.e. 21.6 cm×27.9 cm or other) is provided for printing on and thereafter adhesively attaching to the magnetic side of the flexible magnetic sheet. Alternatively, the flexible magnetic sheet may be pre-laminated with the printable layer and this laminated flexible magnetic sheet can be run through the computer printer as a whole. Also alternatively, the flexible magnetic sheet may be pre-laminated with the printable layer and the static cling vinyl (along with its backing sheet) and can be run through the computer printer as a whole.

The flexible magnetic sheet is then cut into one or more predetermined design shapes (step 608 of FIG. 6). For example, see FIG. 5. Preferably, the shapes are different than standard shapes of a square, rectangle, or circle. For example, it is preferred that the shape be a custom shape or a star, a footprint, a lightning bolt, etc. For a large scale production, the flexible magnetic sheet may be die cut with a plurality of dies to simultaneously form a plurality of the same or different shapes from the same flexible magnetic sheet. For an individual custom-made application, the cut may be made from scissors and along edges of the printed layer coloring and/or design applied on the flexible magnetic sheet.

Preferably, this removable backing sheet of the static cling vinyl is kept in place during the die cutting for protection of the static cling vinyl. After the die cutting, the die cut backing sheets may be removed from each flexible magnet. This will expose the static cling vinyl and any text printed thereon. After die cutting, it may be desired to carry the plurality of flexible magnets on some carrier. If so, then the die cut can merely be a "kiss cut" which penetrates fully through the flexible magnetic sheet and the static cling vinyl sheet, but does not fully penetrate the removable backing sheet of the static cling vinyl. The unwanted flexible magnetic material in between the die cuts may be peeled away from the removable backing sheet of the static cling vinyl and discarded. The remaining plurality of flexible magnets can then be carried on the larger carrier sheet (i.e. the removable backing sheet of the static cling vinyl) and shipped in boxes in a more organized and protected fashion.

It is noted that the order of the steps described in FIG. 6 are preferred in the case where an individual is custom-making a guitar magnet, but this order is not as important for large scale production and may be varied. Summarizing that described in relation to FIG. 6, a method of making one or more guitar pick holders for a guitar includes the acts of receiving a flexible magnet sheet with a static cling vinyl layer for attaching to one side of the flexible magnet sheet; applying a layer of coloring or design to a magnetic surface of the flexible magnetic sheet; and cutting the flexible magnetic sheet into one or more decorative shapes to thereby form the one or more guitar pick holders. The act of applying the printed coloring or design layer may include the further act of applying a layer of printed paper or vinyl having the printed coloring or design.

Figure 7:
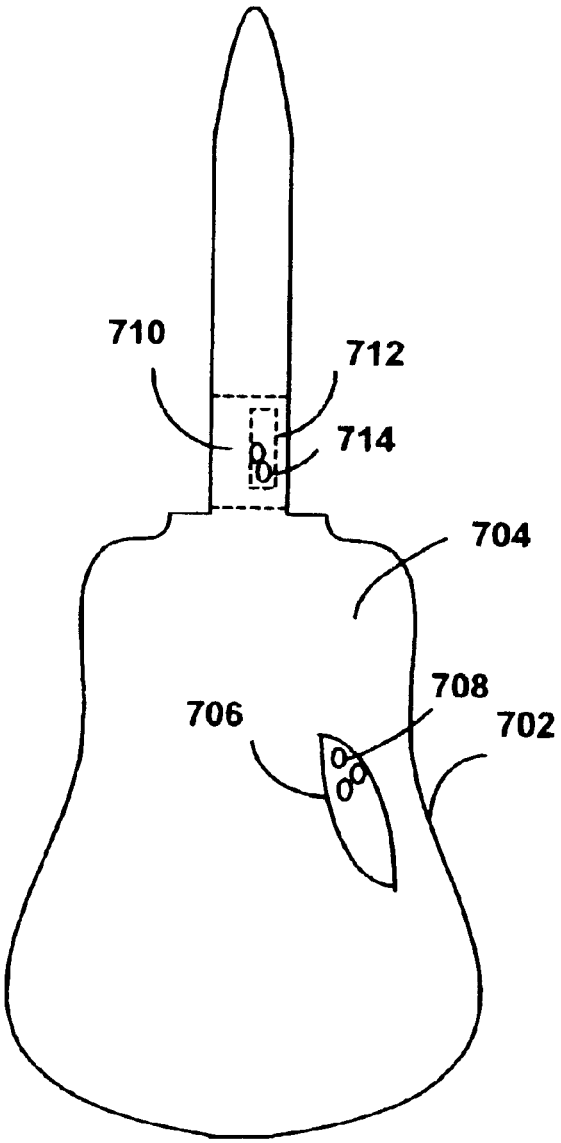
FIG. 7 is an illustration of a guitar case for carrying a guitar, where the guitar case includes a one or more flexible magnets adhered thereto.

FIG. 7 is an illustration of a guitar pick holding system for a guitar case 702 which is configured to carry a guitar (not visible in FIG. 9). Guitar case 702 has a body which includes an outside surface 704. Similar to those teachings described above, a flexible magnet 706 is adhered to outside surface 704 of guitar case 702. The length of flexible magnet may vary and be, for example, about 10 inches. Flexible magnet 706 has an adhering surface, such as an adhesive surface, for adhering it to outside surface 704. Before it is applied, a removable backing sheet formed over the adhering surface of flexible magnetic body 706 is removed. A plurality of guitar picks 708 with magnetically receptive material may be magnetically held by this flexible magnetic body 706, and thus attached to guitar case 702. The magnetic forces of the guitar pick holding system are sufficiently strong such that guitar picks 708 are normally held to flexible magnetic body 706 even when guitar case 702 is carried by a user or shaken. Flexible magnetic body 706 may have additional suitable qualities and characteristics as other flexible magnetic bodies described above in relation to FIGS. 1–5.

It is well-known that many guitar cases (especially hard-shell guitar cases) come equipped with a guitar case compartment 710, commonly used to store various guitar accessories (guitar picks, guitar strings, etc.). An alternative placement or guitar pick holding system is shown in FIG. 7. A flexible magnetic body 712 may be adhered (e.g. adhesively attached) inside of guitar case 702, preferably on or within guitar case compartment 710, for magnetically carrying a plurality of guitar picks 714. For example, flexible magnetic body 712 may be adhered to an outside or inside surface of a hinged door of guitar case compartment 710. Before flexible magnetic body 712 is applied, a removable backing sheet formed over the adhering surface is removed. Flexible magnetic body 712 may have additional suitable qualities and characteristics as other flexible magnetic bodies described above in relation to FIGS. 1–5.

Figure 8:
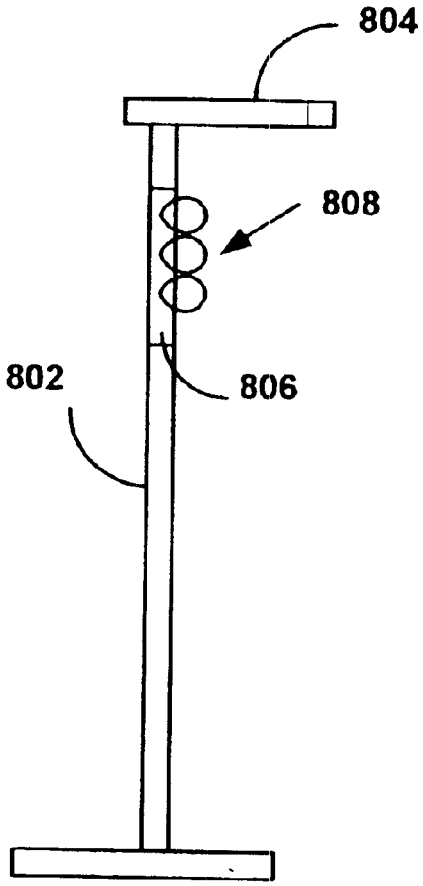
FIG. 8 is an illustration of a microphone stand for carrying a microphone, where the microphone stand includes a flexible magnet adhered thereto.

FIG. 8 is an illustration of a guitar pick holding system for a microphone stand 802 which is configured to carry a microphone 804. Microphone stand 802 typically has at least one metal rod. Similar to those teachings described above, a flexible magnetic body 806 is adhered to the metal rod of microphone stand 802. In one embodiment, flexible magnetic body 806 may be attached around most if not all of a circular perimeter of the metal rod of microphone stand 802. In this case, the width of flexible magnetic body 806 is preferably equal to the circular perimeter of a standard microphone rod. The length of flexible magnet 806 may vary and be, for example, about 10 inches. However, any suitable length, such as any length between 4 and 15 inches, may be appropriate. Flexible magnetic body 806 has an adhering surface, such as an adhesive surface, or alternatively a magnetic surface for attaching to the rod of microphone stand 802. In the latter case, flexible magnetic body 806 has a front magnetic surface for holding guitar picks and a rear magnetic surface for magnetically adhering to microphone stand 802. Also for this latter case, flexible magnetic body 806 is sufficiently flexible such that it adheres arcuately around a portion of the metal rod of microphone stand 802. Thus, a plurality of guitar picks 808 with magnetically receptive material may be magnetically held by this flexible magnetic body 806, and thus attached to microphone stand 802.

Thus, from FIGS. 7 and 8, a guitar pick holder includes a flexible magnet; a rear adhering surface of the flexible magnet for use in adhering the flexible magnet to a surface of one of a guitar case and a microphone stand; and a front magnetic surface of the flexible magnet for use in magnetically holding a magnetically receptive guitar pick. The rear adhering surface of the flexible magnet may include an adhesive layer for adhesively adhering to an inside or outside surface of a guitar case or to a microphone stand. Alternatively, the rear adhering surface of the flexible magnet may include a magnetic field for magnetically adhering to the microphone stand.

Final Comments. Advantageously, methods of making guitar pick holders from flexible magnetic materials are described. In one illustrative example, a magnetic side of a flexible magnetic sheet is laminated with a vinyl sheet which provides a coloring and/or design. The side opposite this magnetic side is laminated with a static cling vinyl sheet, after text is reverse-printed on its non-static cling side. Text may also be printed on the vinyl sheet. The laminated flexible magnetic sheet is then die cut to simultaneously form a plurality of guitar pick holders of a predetermined shape. Other methods are described, including methods of making custom individual holders.

It is to be understood that the above is merely a description of preferred embodiments of the invention and that various changes, alterations, and variations may be made without departing from the true spirit and scope of the invention as set for in the appended claims. The guitar utilized may be an acoustic or an electrical guitar, which may be a 6-string electric guitar or a bass guitar. The flexible magnet may be integrally formed using a less flexible plastic (or larger quantities of plastic) to become a relatively harder and more rigid (but still flexible) magnetic body. In addition, each of the embodiments described herein may all be "reversed" such that the flexible body is integrally provided with the magnetically receptive material (e.g. metal such as iron, nickel, cobalt, etc.) and the guitar pick is provided with the magnetic material (within it or on each surface). Few if any of the terms or phrases in the specification and claims have been given any special particular meaning different from their plain language meaning, and therefore the specification is not to be used to define such terms in an unduly narrow sense.

What is claimed is:

1. A method of making guitar pick holders from flexible magnetic material, comprising:

receiving a flexible magnetic sheet having a magnetic side with a laminate sheet adhered thereto;

adhering a static cling vinyl sheet to a side opposite the magnetic side of the flexible magnetic sheet; and die cutting the laminated flexible magnetic sheet into a plurality of guitar pick holders of a predetermined shape.

2. The method of claim 1, further comprising:

prior to the adhering, reverse printing text on a non-static cling side of the static cling vinyl sheet.

3. The method of claim 1, further comprising:

printing color, design, and/or text on the laminate sheet.

4. The method of claim 1, further comprising:

laminating the magnetic side of the flexible magnetic sheet with the laminate sheet.

5. The method of claim 1, further comprising:

wherein a static cling side of the static cling vinyl sheet has a backing sheet adhered thereto; and during the adhering and die cutting, maintaining the backing sheet on the static cling vinyl sheet.

6. The method of claim 1, wherein the act of die cutting comprises kiss cutting.

7. The method of claim 1, wherein the predetermined shape is a shape other than a rectangle or circle.

8. The method of claim 1, wherein the laminated sheet provides for a decorative design for a guitar.

9. The method of claim 1, further comprising:

wherein the laminate sheet comprises a vinyl sheet.

10. The method of claim 1, further comprising:

wherein the laminate sheet provides a holographic design.

11. A method of making a guitar pick holder for a guitar, comprising:

applying a design, coloring, and/or text to a magnetic side of a flexible magnetic sheet which has an adhering side opposite the magnetic side; and cutting the flexible magnetic sheet into a shape to form the guitar pick holder.

12. The method of claim 11, wherein the adhering side of the flexible magnetic sheet comprises an adhesive, and the flexible magnetic sheet further comprises a removable backing sheet formed over the adhesive.

13. The method of claim 11, wherein the adhering side of the flexible magnetic sheet comprises static cling vinyl, and the flexible magnetic sheet further comprises a removable backing sheet formed over the static cling vinyl.

14. The method of claim 11, wherein the act of applying comprises the act of printing on a printable material formed at least partially over the magnetic side of the flexible magnetic sheet.

15. The method of claim 11, wherein the act of applying comprises the act of printing on a printable sheet of material which is subsequently adhered to at least a portion of the magnetic side.

16. The method of claim 11 wherein the act of applying comprises the act of printing over at least a portion of the magnetic side of the flexible magnetic sheet.

17. The method of claim 11, wherein the act of applying comprises the act of applying a vinyl sheet over at least a portion of the magnetic side of the flexible magnetic sheet.

18. The method of claim 11, wherein the adhering side is for adhering the guitar pick holder to a surface of the guitar and the magnetic side is for magnetically carrying one or more magnetically receptive guitar picks.

19. A method of making guitar pick holders from flexible magnetic material, comprising:

receiving a flexible magnetic sheet having a magnetic side with a laminate sheet adhered thereto, an adhering side opposite the magnetic side, and a removable backing sheet formed over the adhering side; and die cutting the laminated flexible magnetic sheet into a plurality of guitar pick holders of a predetermined shape.

20. The method of claim 19, wherein the adhering side comprises adhesive.

21. The method of claim 19, wherein the adhering side comprises static cling vinyl.

22. The method of claim 19, further comprising:

laminating the flexible magnetic sheet with the laminate sheet.

23. The method of claim 19, further comprising;

printing a design, color, and/or text over the laminate sheet.

24. The method of claim 19, further comprising:

adhering a static cling vinyl sheet to a side opposite the magnetic side to create the adhering side of the flexible magnetic sheet.

25. The method of claim 19, further comprising:

adhering a static cling vinyl sheet to a side opposite the magnetic side to create the adhering side of the flexible magnetic sheet; and prior to the adhering, reverse printing text on a non-static cling side of the static cling vinyl sheet.

* * * * *